US005301965A

United States Patent [19]

Floreani

[11] Patent Number: 5,301,965

[45] Date of Patent: Apr. 12, 1994

[54] SNOW SKI

[75] Inventor: Adrian J. Floreani, Anahiem, Calif.

[73] Assignees: Richard Floreani; Eleanor Floreani

[21] Appl. No.: 588,492

[22] Filed: Sep. 26, 1990

Related U.S. Application Data

[60] Continuation of Ser. No. 258,384, Oct. 17, 1988, abandoned, which is a division of Ser. No. 923,208, Oct. 21, 1986, Pat. No. 4,778,197, which is a continuation-in-part of Ser. No. 689,605, Jan. 7, 1985, abandoned.

[51] Int. Cl.[5] ..... A63C 5/025; A63C 5/048; A63C 5/075

[52] U.S. Cl. ..... 280/600; 280/602; 280/608

[58] Field of Search ..... 280/610, 609, 601, 602, 280/817, 600

[56] References Cited

U.S. PATENT DOCUMENTS

| | | | |
|---|---|---|---|
| 4,085,947 | 4/1978 | Sarrer | 280/609 |
| 4,778,197 | 10/1988 | Floreani | 280/602 |

FOREIGN PATENT DOCUMENTS

| | | | |
|---|---|---|---|
| 337581 | 11/1974 | Austria | 280/601 |
| 1958349 | 5/1971 | Fed. Rep. of Germany | 280/609 |
| 2279431 | 2/1976 | France | 280/602 |
| 88426 | 2/1937 | Sweden | 280/609 |
| 558185 | 1/1975 | Switzerland | 280/601 |

OTHER PUBLICATIONS

Curtin Sprague, "How to Make It Book of Crafts" 1st Ed. Pellham, N.Y., Bridgman Pub. Inc., 1941, pp. 172-173.

John Howe, "Skiing Mechanics", Poudre Press, Laporte, Co., 1983, p. 22.

*Primary Examiner*—Karin L. Tyson

*Attorney, Agent, or Firm*—Ladas & Parry

[57] ABSTRACT

The ski includes a forebody, waist and tail section, with a running surface extending from an upturned front tip to the tail. The ski has sideouts formed with a continuous, constant radius of curvature along the entire length of the running surface. A ski binding area is provided on the top surface of the ski with the toe of the boot of the ski binding area rearward of the median of the length of the running surface, with the running surface rearward of the heel of the boot providing approximately less than 20% of the total length of the running surface of the ski. A chamber in the front section of the ski is filled with flowable material; and there is also provided concave undersurface toward the tail of the ski.

38 Claims, 4 Drawing Sheets

SNOW SKI

This is a continuation of co-pending application Ser. No. 07/258,384 filed Oct. 17, 1988, now abandoned, which is a divisional of U.S. Ser. No. 923,208, filed Oct. 21, 1986(now U.S. Pat. No. 4,778,197, granted Oct. 18, 1988), which is a continuation-in-part of U.S. Ser. No. 689,605, filed Jan. 7, 1985 (now abandoned).

BACKGROUND OF THE INVENTION

1. Field of the Invention

This invention is directed to a snow ski providing easy maneuverability for beginner and intermediate snow skiers. More particularly, the ski of the invention comprises a ski having a side cut on each longitudinal side, and a tail portion providing less than twenty per cent of the running surface of the ski.

2. Prior Art

Heretofore, in order to improve a ski's performance at high-speed racing conditions, the ski would generally have to made longer and stiffer. However, in doing so the ski becomes more difficult to turn and is not well suited for a beginner or intermediate recreational skier. The length of the front portion of a ski contributes to the vibration dampening characteristics of the ski, and the length of the tail of the ski contributes to the tracking of the ski. Conventional skis are generally constructed with a slight arch to provide camber to the ski, enabling the skier to present an even distribution of his weight along the running surface of the ski which contacts the snow, providing for traction and stability, both in straight skiing, and in turns. Conventional skis are also provided with some degree of narrowing toward the middle or waist of the ski to provide what is termed "side cut", which permits the skier to present a curved edge of the ski to the snow during a turn.

This curved edge serves two purposes. The first is that this curved edge forces the ski to follow a curved path when the ski is placed on edge. The second is that the curved edge provides a more even weight distribution along the edge in the same manner as camber provides for more even weight distribution along the entire running surface. The combination of side cuts and camber provides for stability and traction in turns.

A wide variety of turning techniques have been devised to provide methods of turning, with many of the techniques being unsuitable or difficult to use by beginners and intermediate skiers with conventional high performance skis. In order for a skier to turn on conventional skis the skier must normally displace the tail of the skis sideways a certain distance before forward pressure can be added to effect a turn. Conventional skis normally require a great deal of forward pressure to reverse the camber of the ski to present an edge for turning. The sideways displacement of conventional skis is usually accomplished by unweighting, a jumping action, a sliding action, or a combination of such motions. After this sideward displacement is accomplished the skis can be turned by applying pressure to the edge of the ski which is to form the inside edge of the turn. For stiffer, high performance skis, a downward jumping action is required to reverse the camber of the ski sufficiently to initiate a short radius turn. The sideways displacement of the tail and the reversal of camber of the ski are perhaps the most difficult and unnatural things to learn. Beginner and intermediate skiers typically never learn these motions. This type of skiing also requires a great deal of energy, and still involves a number of motions before a turn can actually be initiated.

The present invention provides for a ski with sidecuts and a tail portion providing less than twenty percent of the running surface of the ski, which is suitable for use by beginners and intermediate skiers which provides high performance characteristics normally only obtainable by a longer and stiffer conventional ski, providing easy turning and maneuverability, as well as stability. The present invention also provides for a ski having a hollow chamber in the forebody extending from one longitudinal side to the other, containing a flowable material, to provide for improved vibration dampening characteristics.

U.S. Pat. No. 4,007,946 (Sarver) discloses a flat, short, tapered ski, which is wide in the front, and narrow at the tail with a ski binding area placing the toe of the boot behind the median of the length of the ski, and the heel of the boot of the ski binding area being specifically approximately 6 inches forward of the tail end of the ski. The tapering of the width of the ski is continuous, providing for a narrow tail which digs into the snow, with the front portion of the running surface riding above the snow. An optional lift for the heel is also provided to provide a more level platform for the skier. U.S. Pat. No. 4,085,947 (Sarver) also discloses a short ski, which permits pivoting of the ski at the tail for purposes of turning. Swiss Patent No. 558,185 (Schwarz) discloses vibration damping side wall chambers and chambers for a top skin of a ski, which are filled with materials to provide for vibration dampening. Japanese Kokai No. 54-98831 (Seizo KK) also discloses a ski having fillable grooves or channels which may contain solid or liquid matter, which contribute to the vibration dampening characteristics of the ski. French Patent No. 1,163,480 (Biringer) also shows a ski having two hollow chambers separated by a septum, which are fillable with various materials. Conventional skis also have the ski boot binding area placed so that an average ski provides for approximately 40% of the running surface in the tail of the ski rearward of the heel of the boot in the binding area. It would be possible, but not advisable, to place a large adult size 13 boot on a small four foot children's ski, which would provide for a tail running surface behind the boot of as little as 23%. However, none of the prior art of which the applicant is aware teaches or discloses a ski having the improved performance characteristics of the invention, providing for ease of maneuverability and stability, which are provided for by the unique features of the invention.

SUMMARY OF THE INVENTION

This invention is directed to a ski, designed to provide improved maneuverability and stability, particularly for beginner and intermediate skiers. Most preferably, a pair of the skis is to be used, although it is possible to maneuver on only one ski, due to the excellent stability and maneuvering characteristics of the ski. The ski generally comprises in one preferred embodiment a forebody, a waist, and a tail section, with the forebody including a front tip turned upwardly, to provide an upturned shovel section. The tail section has a rear tip turned upwardly to provide an upturned tail section, and the bottom or running surface of the ski extends approximately from the shovel section to the upturned tail section, providing a running surface for the ski. The ski is narrower at the waist and wider at the front tip and at the tail, having two longitudinal sides or edges extending the length of the running surface, with each of the sides curving inwardly about the waist area to provide sidecuts on each of the sides along approximately the length of the running surface. A ski binding area is also located on the top surface of the ski, disposed with reference to the total length of the running surface of the ski, such that the toe of the boot is disposed rearwardly of the approximate median of the length of the running surface, with the portion of the running surface of the tail of the ski extending from approximately the heel of the boot in the ski binding area rearwardly providing approximately less than 20% of the total length of the running surface of the ski.

Most preferably, the ski also comprises generally planar top and bottom elements providing the top and bottom surfaces, joined along their outer perimeter, and spaced apart at the medial portions in the forward portion of the ski, to form a hollow section or chamber extending from one longitudinal edge to the other. This hollow chamber preferably contains a flowable material or combination of materials capable of absorbing vibrations of the ski, and providing additional mass to the front portion of the ski, capable of shifting freely from side to side and forward and backward within the front portion of the ski, in order to damp vibrations and increase the stability of the ski.

Most preferably, the bottom surface of the ski has an underside which is curved upwardly from one longitudinal edge to the other so as to form a concave undersurface at least at the tail of the ski, providing for tracking of the ski.

It is therefore an object of the invention to provide for a ski having a shorter tail area than conventional skis with side cuts about the waist along the entire length of the running surface of the ski. A further object of the invention is to provide a ski which has a shorter tail portion than the conventional long, high performance skis with improved maneuvering characteristics. It is also an object of the invention to provide a ski with improved damping characteristics in the front section of the ski; and yet another object of the invention is to provide a ski with a short tail providing for a good tracking of the ski.

Further objects and advantages of the invention will become apparent from the drawings and description of the invention contained below.

DETAILED DESCRIPTION OF THE INVENTION

Figure 1:
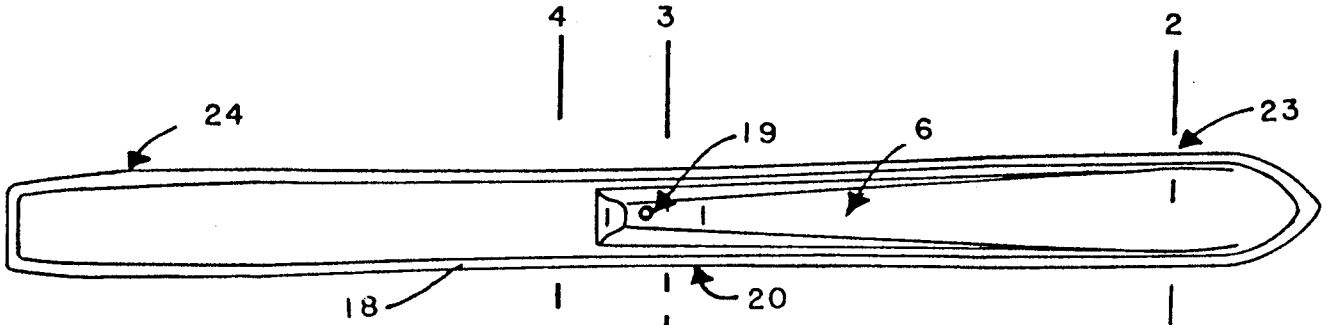
FIG. 1 is a top view of a ski, embodying the present inventions.
Figure 2:
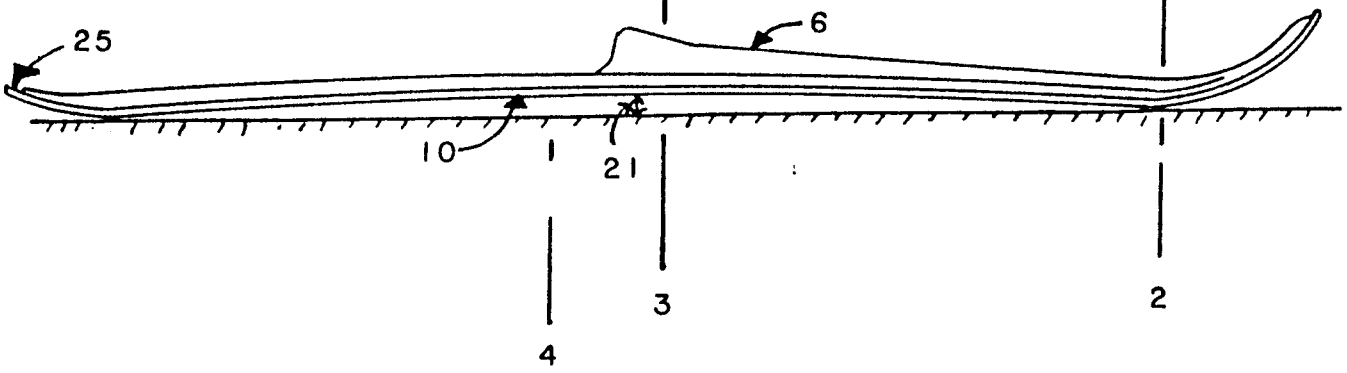
FIG. 2 is a side elevation view of FIG. 1.
Figure 9:
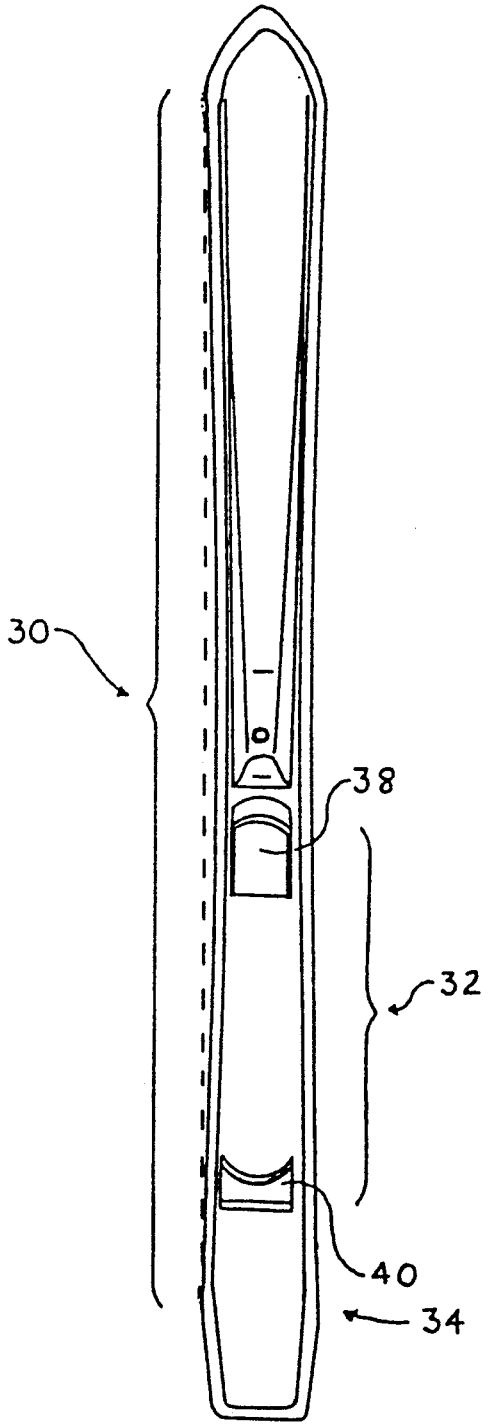
FIG. 9 is a top plan view of the ski of the invention showing the placement of the ski binding area and the side cuts.

The preferred ski of the invention is best seen in FIGS. 1, 2 and 9. The ski has an upturned shovel section at the front of the ski, an upturned tail section at the rear of the ski and a running surface between the shovel section and the upturned tail section, the running section being that portion of the ski which contacts the snow when skiing on packed snow. The ski of the invention generally comprises a top skin or top element 6 and a bottom skin or bottom element 10, sealed together along the entire perimeter of the ski 18. The top and bottom skins are preferably composed of a strong, flexible material such as high strength sheet molding compound (SMC), polycarbonate, or other high strength moldable material. The top and bottom skins are preferably bonded together along the entire perimeter 18 by welding them together by heat and pressure, but suitable lamination and adhesives may also be a satisfactory alternative for bonding the top and bottom skins together. The medial portion of the top element 6 is preferably spaced apart from the bottom skin in approximately the front half of the ski, with the top element 6 being molded to provide a hollow section or chamber 14 in the front of the ski. The vibration and shock dampening characteristics, weight, balance and the relationships these parameters produce on a ski's performance can simply be controlled and varied by introducing a suitable filler material into the front hollow section 14. This filler material could be, for example, a liquid such as oil or glycol, mercury, lead shot, steel BB's, granules or combinations of any of such filler materials. It has been found that a combination of a viscous liquid such as oil and lead shot or steel BB's gives the ski a very smooth and vibration free ride at high speeds, even in rough and heavy broken snow conditions.

The filler materials can be added after assembly of the ski through an orifice 19 by the skier. The orifice or fill hole 19 not only allows the individual skier to adjust the ski's performance characteristics to his preference, but allows a manufacturing company to produce a standardized preferred ski which can still be readily adapted to meet a skier's individual preferences.

The top and bottom elements of the skis can be molded separately by vacuum, thermoforming, drape, pressure, and other conventional procedures, and clamped and bonded along the entire outer perimeter, which can be a much faster, simpler, cheaper and more consistent process than conventional lamination techniques. The bottom element can be contoured and shaped as desired and does not have to be flat as with conventional skis.

The medial portions of the top skin 6 and bottom skin 10 are also preferably spaced apart in the waist or middle portion of the ski as well as in the tail portion of the ski. As is shown in FIGS. 4 and 5, a solid core 7 may also be inserted in a portion of the hollow chamber and in the waist or tail portion of the ski in order to provide desired flexibility and torsion characteristics, and flex beams or vertical support members 8 may also be provided to add structural rigidity and support at the edges of the ski on either side of the solid core material 7.

Figure 4:
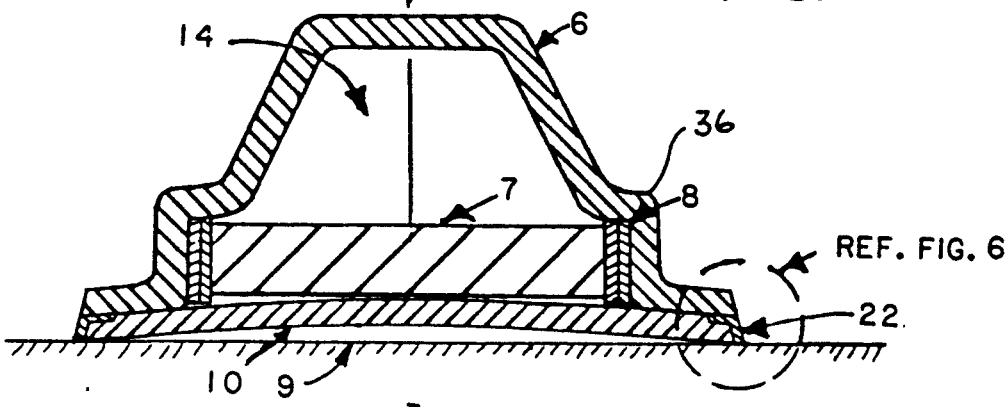
FIG. 4 is a cross sectional view of FIG. 1 and FIG. 2 just before the binding area, as indicated by section lines 3—3.
Figure 5:
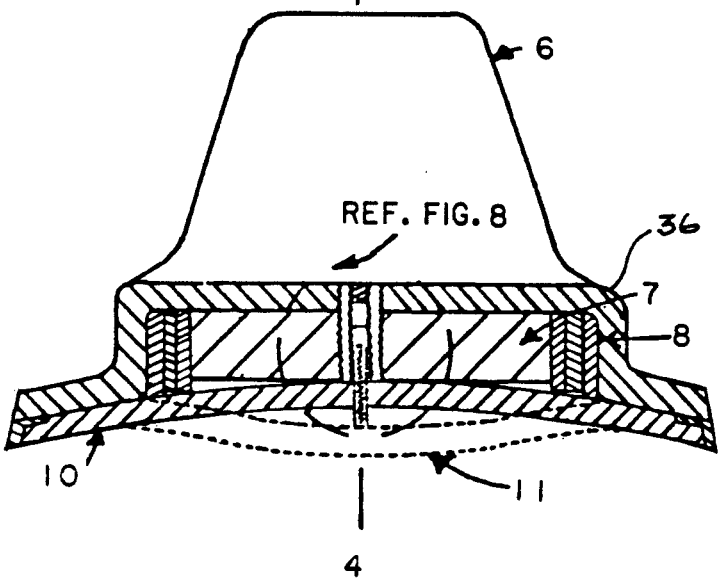
FIG. 5 is a cross sectional view of FIG. 1 and FIG. 2 at the binding area, as indicated by section lines 4—4.
Figure 6:
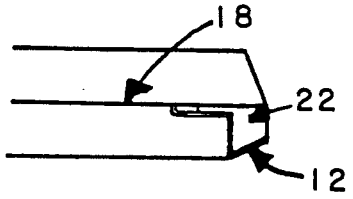
FIG. 6 is an exploded view of the steel ski edge as indicated by the area marker of FIG. 4.
Figure 7:
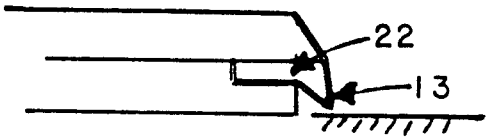
FIG. 7 is another embodiment of the ski with a modified ski edge.

As is also illustrated in FIGS. 4 and 5, the portion of the ski from the waist area toward the tail has an increasingly upwardly curved bottom surface portion on the undersurface of the bottom skin 10, providing for the tracking of the tail portion of the ski. Thus, although the short ski of the invention is generally preferably just under four feet long, the features of the invention make for easier control than any longer ski in the prior art. The performance at high speed racing conditions has proven to be equal or better than most long, stiff racing skis of the prior art. The preferred resultant ski uses a viscous liquid and lead shot or steel BB's in the hollow front half of the ski, combined with the molded concave bottom surface 10 particularly at the tail section of the ski, in combination with continuous constant radius sidecuts and beveled edges 12 or 13, as are illustrated in FIGS. 6 and 7. The beveled edge 12 allows the ski to slide into a turn, even when the ski has a deeply concave undersurface, which would normally inhibit the ski from initiating a turn; and the sharply pointed edge 13 shown in FIG. 7 provides for stronger gripping action of the edge, and is known as a "super carver edge". The liquid and shot gives the ski a smooth, vibration free, shock absorbing quality only found on prior art, long, heavy racing skis. The continuous, constant radius sidecuts and molded concave bottom give the short ski the holding, carving and tracking ability only found on prior art long racing skis.

Figure 3:
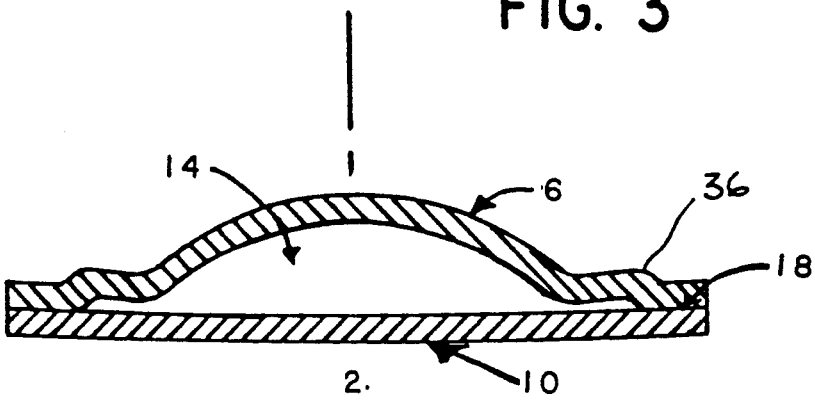
FIG. 3 is a cross sectional view of FIG. 1 and FIG. 2 at the toe area of the ski, indicated by section lines 2—2.

Referring to FIGS. 4 and 5, the flexural distribution, flexibility, or stiffness of the ski along its longitudinal axis is controlled by materials in laminates and fillers of conventional skis, but in the present invention can be contolled by the height, cross-sectional area and composition of the top element 6. Not only does the central raised portion of the top element 6 as shown in FIGS. 3, 4, and 5 contribute to the structural strength and rigidity of the ski along its length, but also the height and structure of the angled shoulders 36, which are shown as being further supported by the flex beams 8 in FIGS. 4 and 5, which are in turn supported and held in place by the solid core station 7. The front section as shown in FIG. 3 provides for the both flexibility at the front section of the ski, in order to assist in the vibration damping which is also provided for by the filler material in the hollow section 14. The material of the flex beams 8 located along the side walls of the ski may be high strength spring steel or graphite composite. The solid core material 7 also provides for a strong, thick anchoring section for holding the ski binding screws at the ski binding area 32, as is shown in FIG. 9.

Further referring to FIGS. 3 and 4, the operation or performance of skis made with the preferred hollow front section 14 of the invention can be changed and improved beyond skis of the prior art by filling this hollow cavity with a material that will add weight to the tip and also absorb vibrations that normally occur when skis are travelling fast on hard or bumpy snow. This void area is preferably filled with a non-solid material which is flowable, such as granules, or a fluid such as glycol, oil, mercury or other liquid that will remain in a liquid state at all ski condition temperatures. The liquid adds weight to the tip and thus helps the ski break through and ride bumpy snow by absorbing some of the impact and vibration that would otherwise be transmitted back to the skier's feet and legs. This liquid mass dampering feature is preferably further enhanced by the addition of shot, such as nickel plated lead shot, or steel or lead BB's, to the fluid material. The addition of the shot, by this added weight, further increases the momentum and inertial resistance of the ski's tips to shocks and bumps, and thus makes the skis ride even smoother at higher speeds. The shot also absorbs vibration, the vibration energy being transmitted to the shot and then dissipated through absorption into the dampening liquid. As mentioned above, the skier can adjust the amount of fluid and the amount of weight and the hollow front section by way of the fill hole 19, in order to meet individual preferences.

An alternative feature of the invention is also shown in FIGS. 3, 4 and 5. The operational performance of the skis of the invention can be changed additionally by molding or varying the shape of the undersurface of the bottom element 10 along the ski's length, as is shown in FIGS. 3 and 4. A convex shape of the bottom element 10 may be provided as shown in FIG. 3, or a moderately concave shape may be provided for bottom surface 10 as in FIG. 4, or even a deeply concave surface for the bottom element 10 as in FIG. 5. This is referred to as a contoured bottom.

The convex bottom surface 10 in FIG. 3 at the front of the ski keeps the edges slightly off the snow so that they will not detach or hook the snow, which can possibly cause a skier to fall. A convex front section also makes the skis easier to turn. Conventional skis are usually dulled or beveled at the tips and tails, or are provided with reverse camber in order to prevent the skis from hooking, and to permit easier turning. Such adaptations conventional skis having long tails can sacrifice performance at higher speed carving turns, especially on hard snow conditions. The concave undersurface provided under the ski binding 32 in the present invention and behind the binding 32 gives the skis a greater tracking ability and more edge bite than is provided in conventional flat skis.

Figure 8:
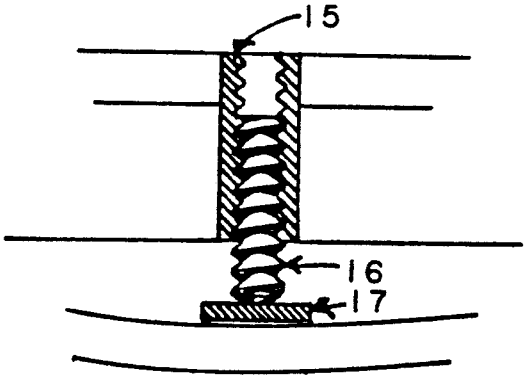
FIG. 8 is an exploded view of the adjustable contoured bottom, as indicated by the area marker of FIG. 5.

Referring to FIG. 5, and the exploded view FIG. 8, the degree of curvature of the concave undersurface of the bottom element 10 may be adjusted by a series of screws 16 with inserts 15 and pressure pads 17 set at distances approximately two inches apart along the center longitudinal axis of the ski. This is an optional feature which would allow a skier to tune the performance of the ski to suit his style and ability or specific need. Another alternative method of affecting the contour of the bottom element 10 is the adjustment of pressure within the front section through a valve inserted at the opening 19. The rear portion of the ski could be adjusted similarly together with the front portion through the same valve, or separately by sealing the front section from the rear section, and providing an additional valve in such a rear section.

The exceptionally deep curvature of the concave surface of the bottom skin 10 requires that the edges 12 be beveled as is shown in FIG. 6 in order to facilitate initiation of a turn. It has been discovered that the deeper the degree of curvature of the concave undersurface, the greater the angle of the beveling 12 should be. However, when the bevel required to initate a turn exceeds five degrees from the horizontal plane of the ski, the edge becomes too dull and loses most of its bite on icy snow.

The edge 13 shown in FIG. 7 is sharply pointed, and is supported above the snow a varying distance according to the degree of curvature of the concave undersurface of the bottom element 10, the width of the ski, and the location along the ski's longitudinal axis. Such an optional edge greatly increases the grip on ice of all skis, including conventional skis. Such an edge allows the skis of the invention a deeper curvature of the concave undersurface, and thus greater tracking and gripping, without sacrificing the sharpness of the steel edge 22 or ease of turning.

In practice, the most preferred embodiment of the ski is approximately four inches wide at the front of the running surface 23, and slightly over three inches wide at the waist 20, and just under four inches wide at the tail 24 at the rear of the running surface. The side cut 30 of the ski is formed in the sides or the edges of the ski on either side, each of the longitudinal edges curving inwardly with a constant radius of curvature to provide a continuous constant radius for the side cuts 30 on each of the edges along the entire length of the running surface of the ski. The forward end of the forebody of the ski at 23 is turned upwardly to provide an upturned shovel section, and the tail section at 24 also turns upwardly to provide an upturned tail section ending at the rear tip 25, with the bottom surface of the ski extending from the shovel section to the upturned tail section providing the running surface for the ski. The side cut of the ski therefore extends with a constant radius of curvature along the length of the ski, from the front portion 23, along the waist 20, to the tail portion at 24. Significantly, the length of the tail portion and the deep sidecuts on the ski of the invention permits easy turning of the ski in the direction in which the weight of the skier leans, contributing to the maneuvering characteristics of the ski. In contrast to normal, conventional skis, the ski of the present invention can be turned in a manner similar to turning ice skates, simply by applying pressure on an edge by leaning the ski onto the edge which will serve as the inside edge for the turn. The greater the angle the ski is placed on the edge, the sharper the angle of the turn will be. At the front tip 23 and the tail portion 24, the skis are in practice about one inch wider than conventional long skis. This extra width gives the skis more speed and flotation in soft snow similar to a much longer conventional ski. The extra width also allows the side cut to be formed with a deeper, constant radius of curvature, thus giving the ski the ability to carve on turns which matches or exceeds that of longer conventional skis.

The camber of the present invention similarly extends from the front portion at 23 to the tail portion at 24 as is shown in FIGS. 1 and 2, to provide stability in straight line tracking, and in combination with the continuous curvature of the side cut, a more even pressure distribution along the edge when the skis are turned to any degree on edge in a turn. This combination also gives the skis rebound or spring going into and out of each turn, which is also referred to as liveliness. Thus, the skis permit acceleration out of a turn, and also provide for absorption of bumps, much like springs.

The tip of the tail portion of the ski at 25 is in practive turned up with the same radius as the tip 23 at the forebody. This inhibits the skis from slowing down or digging in should the skier allow his weight to shift rearward, and also permits the skier to ski backwards, as in ballet skiing.

Another preferred feature of the invention is the shortness of the tail of the ski, defined in relation to the placement of the ski binding area 32, as is shown in FIG. 9. The ski binding area 32 is preferably located on the top surface of the ski 6, disposed with reference to the total length of the running surface of the ski, such that the toe of the boot 38 is disposed rearwardly of the approximate median of the length of the running surface, with the portion 34 of the running surface of the tail 24 extending from approximately the heel of the boot 40 in the ski binding area 32 rearwardly providing approximately less than 20% of the total length of the running surface of the ski. More preferably, the tail portion of the running surface 34 provides less than 15% of the total length of the running surface of the ski. The shortness of the tail in combination with the continuous sidecuts allows for greater maneuverability of the ski, while the preferred concave undersurface at the tail portion provides for compensating tracking of the ski which is normally provided by a long tail on conventional skis, and at the same time the material in the front hollow section provides for stability for the forebody which is normally provided by a long forebody on conventional skis.

The addition of a flowable liquid, mass, or a combination thereof to the front section has a simulated effect of adding length to the front portion of the ski in terms of stability of the ski at high-speed. Thus, a ski using the hollow chamber 14 filled with the flowable materials as are preferred can be made much shorter in the front than a conventional ski without sacrificing high-speed stability. In conventional skis, the high-speed tracking and carving ability is improved by making the skis longer, and a long tail on conventional skis gives the skis straight line stability due to increased resistance of the snow along both sides of the ski's edges at the tail. This resistance helps the skis to track, but also greatly increases the difficulty and force required in turning them. In the present invention, the concave undersurface of the bottom element 10 can be as deep as 1/16 of an inch or greater at the rear tail section of the ski, as is shown FIG. 5, simulating the tracking, carving, and holding ability of longer skis with long tails. Thus, a ski having the feature of a concave undersurface can be made much shorter in this respect than conventional skis without sacrificing carving ability, tracking or holding power on icy snow.

This invention having been described in its preferred and alternative embodiments, it is clear that it is susceptible to numerous modifications and embodiments within the ability of those skilled in the art and without the exercise of the inventive faculty. Thus, it should be understood that various changes in form, detail and usage of the present invention may be made without departing from the spirit and scope of this invention.

I claim:

1. A snow ski having longitudinal edges, the snow ski comprising:

(a) an elongated bottom element;

(b) an elongated top element which is coupled to said bottom element, said top element having a portion which is spaced apart from the bottom element to define a hollow section extending a major portion of the distance between a forward end of the ski and a binding area of the ski and extending a major portion of the distance between the longitudinal edges of the ski; and (c) said hollow section containing a flowable material or combination of materials which flow within said hollow section, said flowable material shifting forward when the forward end of the ski is pointed downward, the mass of the flowable material being added to the mass of the forward end of the ski during downhill skiing to increase the stability of the ski.

2. The snow ski of claim 1, wherein the flowable material or combination of materials absorb shock and rebound of the ski as it collides with the irregularities on the surface of the snow by shifting forward when the forward end of the ski is pointed downward.

3. The snow ski of claim 2, wherein the mass of said flowable material or combination of materials is added to the mass of the forward end of the ski during downhill skiing to increase the inertial stability of the ski.

4. The snow ski of claim 2, wherein said flowable material or combination of materials shifts toward one or the other of the longitudinal edges of the ski when the ski is put on edge during a turn.

5. The snow ski of claim 1, wherein said flowable material or combination of materials shifts away from a higher one of the longitudinal edges of the ski when the ski is put on edge during a turn.

6. The ski of claim 1, wherein said elongated bottom element provides a running surface for the ski, the longitudinal edges including curved sidecuts which extend approximately the entire length of the running surface.

7. The ski of claim 1, wherein the binding area is located with reference to the total length of the running surface of the ski such that the toe of a boot set in the binding is disposed rearwardly of the approximate median of length of the running surface, not including any raised shovel portions at the ends of the ski.

8. The ski of claim 7, wherein the forward end of the ski is turned upwardly to provide an upturned shovel section, a tail of the ski having a rear tip turned upwardly to provide an upturned tail section, and the running surface of the ski extending from said shovel section to said upturned tail section.

9. The ski of claim 1, wherein said longitudinal edges curve inwardly relatively deeply with a constant radius of curvature to provide continuous, constant radius sidecuts.

10. The ski of claim 1, wherein said elongated top element has a medial portion and elongated side walls extending from said medial portion toward said longitudinal edges.

11. The ski of claim 1, wherein the height and shape of the sidewalls affect the flexural modulus of the ski along said hollow portion.

12. The ski of claim 1, wherein said elongated top element is affixed to said elongated bottom element along the longitudinal edges of the ski.

13. A snow ski having longitudinal edges, the snow ski comprising:

(a) an elongated bottom element;

(b) an elongated top element which is coupled to said bottom element, said top element having a portion which is spaced apart from the bottom element to define a hollow section extending into a forward end of the ski and extending a major portion of the distance between the longitudinal edges of the ski;

(c) said hollow section containing a flowable material or combination of materials which flow within said hollow section; and (d) said bottom element having a bottom surface which is concave from the middle of the ski to the tail of the ski.

14. The ski of claim 13, wherein said bottom surface becomes increasingly concave toward the rear of the ski.

15. The ski of claim 1, wherein said flowable material or combination of materials is selected from glycol, oil, mercury, shot, granular material or any combination thereof.

16. The ski of claim 1, wherein said flowable material or combination of materials comprises a mixture of an oil and metallic material.

17. The ski of claim 1, wherein said top element includes an inlet for introducing said flowable material or combination of materials into said hollow section.

18. A snow ski having longitudinal edges, the snow ski comprising:

(a) an elongated bottom element;

(b) an elongated top element which is coupled to said bottom element, said top element having a portion which is spaced apart from the bottom element to define a hollow section extending into a forward end of the ski and extending a major portion of the distance between the longitudinal edges of the ski;

(c) said hollow section containing a flowable material or combination of materials which flow within said hollow section; and (d) said hollow section is presserizable for adjustment of the contour of said bottom element.

19. A snow ski having an elongated bottom element for contacting snow, the bottom element having a running surface defining that portion of the bottom element which excludes any raised shovel portions at the ends of the skis, the ski having a binding area which is located with reference to the total length of the running surface of the ski such that the toe of a boot set in the binding area is disposed rearwardly of the approximate median of the length of the running surface, said ski further including means for weighing the forward end of the ski during downhill skiing for impeding the rebound or bounce of the ski as it collides with irregularities in the snow's surface.

20. The snow ski of claim 19, wherein the forward end of the ski is turned upwardly to provide an upturned shovel section, a tail of the ski having a rear tip turned upwardly to provide an upturned tail section, and the running surface of the ski extending from said shovel section to said upturned tail section 21. The snow ski of claim 19, wherein said ski has longitudinal edges which curve inwardly relatively deeply with a constant radius of curvature to provide continuous, constant side cuts.

22. The snow ski of claim 19, wherein said ski has an elongated top element affixed to said bottom element along longitudinal edges of said ski.

23. The snow ski of claim 21, wherein said elongated top element has a medial portion and elongated side walls extending from said medial portion toward said longitudinal edges, said longitudinal edges forming a hollow section for the major length of the ski.

24. The snow ski of claim 23, wherein the height and shape of the sidewalls affect the flexural modules of the ski along said hollow portion.

25. The snow ski of claim 19, wherein said bottom element has a bottom surface which is curved upwardly rearwardly so as to form a concave undersurface extending most of the distance of the running surface between longitudinal edges of said ski rearwardly of the median of said ski.

26. The ski of claim 19, wherein said bottom surface becomes increasingly concave toward the rear of the ski.

27. The ski of claim 19, wherein said weighing means includes materials selected from glycol, oil, mercury, shot, granular material or any combination thereof.

28. The ski of claim 19, wherein said weighing means comprises a mixture of oil and a metallic material.

29. A snow ski having an elongated bottom element for contacting snow, the bottom element having a running surface defining that portion of the bottom element which extends from a bottom of a front splay or shovel portion to the bottom of a rear splay or upturned tail section, which running surface is further described as that part of the ski which would make contact with a very hard flat surface when a skier was standing in a binding of the ski, the ski having a binding area which is located with reference to the total length of the running surface of the ski such that the toe of a boot set in the binding area is disposed rearwardly of the approximate median of the length of the running surface, said ski further having longitudinal edges including curved side cuts which extend approximately the entire length of said running surface.

30. The ski of claim 29, wherein the forward end of the ski is turned upwardly to provide an upturned shovel section, a tail of the ski having a rear tip turned upwardly to provide an upturned tail section, and the running surface of the ski extending from said shovel section to said upturned tail section.

31. The ski of claim 29, wherein said longitudinal edges curve inwardly relatively deeply with a constant radius of curvature to provide continuous, constant side cuts.

32. The ski of claim 29, further including an elongated top element affixed to said bottom element along said longitudinal edges of said ski.

33. The ski of claim 32, wherein said elongated top element has a medial portion and elongated side walls extending from said medial portion toward said longitudinal edges, said longitudinal edges forming a hollow section for the major length of the ski forward of said binding area.

34. The ski of claim 33, wherein the height and shape of the side walls effect the flexural modulus of the ski along said hollow portion.

35. The ski of claim 29, wherein said bottom element has a bottom surface which is curved upwardly rearwardly so as to form a concave undersurface extending most of the distance of said running surface between said longitudinal edges rearwardly of the median of the ski, to include an entire rear portion of the running surface.

36. The ski of claim 29, wherein said bottom surface becomes increasingly concave toward the rear of the ski.

37. The snow ski of claim 1, wherein said flowable material or combination of materials is unrestrained within said hollow section of the ski from approximately the left longitudinal edge to approximately the right longitudinal edge and thereby is permitted to shift and spread by gravity and or other dynamic principals of motion between said longitudinal edges of the ski when said ski is put up on edge during a turn, thereby increasing the weight, inertia and stability of that edge with respect to snow upon which the ski is turning.

38. The ski of claim 35 further including outside edges having a sharpened corner which is offset above the running surface of the ski.

* * * * *